US009909383B2

(12) United States Patent
Solhaug

(10) Patent No.: US 9,909,383 B2
(45) **Date of Patent: *Mar. 6, 2018**

(54) SWELLABLE PACKER WITH ENHANCED OPERATING ENVELOPE

(71) Applicant: Halliburton Energy Services, Inc., Houston, TX (US)

(72) Inventor: Kristian Solhaug, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/462,200

(22) Filed: Mar. 17, 2017

(65) Prior Publication Data

US 2017/0191343 A1 Jul. 6, 2017

Related U.S. Application Data

(63) Continuation of application No. 14/400,963, filed as application No. PCT/US2012/043287 on Jun. 20, 2012, now Pat. No. 9,617,821.

(51) Int. Cl.
*E21B 33/12* (2006.01)
*E21B 33/127* (2006.01)
*E21B 33/128* (2006.01)

(52) U.S. Cl.
CPC ..... *E21B 33/1208* (2013.01); *E21B 33/12* (2013.01); *E21B 33/127* (2013.01); *E21B 33/128* (2013.01); *E21B 33/1216* (2013.01); *E21B 33/1277* (2013.01)

(58) Field of Classification Search
CPC ..... E21B 33/12; E21B 33/127; E21B 33/128; E21B 33/1216; E21B 33/1277; E21B 33/1208
See application file for complete search history.

(56) References Cited

U.S. PATENT DOCUMENTS

| | | | | |
|---|---|---|---|---|
| 4,161,319 | A | 7/1979 | Stocking | |
| 5,701,959 | A | 12/1997 | Hushbeck et al. | |
| 9,617,821 | B2 * | 4/2017 | Solhaug | E21B 33/1208 |
| 2008/0185158 | A1 | 8/2008 | Chalker et al. | |
| 2009/0200043 | A1 | 8/2009 | Olinger | |

FOREIGN PATENT DOCUMENTS

WO WO-2010/056636 A1 5/2010

OTHER PUBLICATIONS

Search Report and Written Opinion dated Feb. 1, 2013 for International Application No. PCT/US12/43287, 9 pages.

* cited by examiner

*Primary Examiner* — Yong-Suk Ro
(74) *Attorney, Agent, or Firm* — Locke Lord LLP; Joshua L. Jones

(57) ABSTRACT

A swellable packer can include a base pipe, at least one swellable seal on the base pipe, the seal comprising a swellable material, and at least one other swellable seal on the base pipe, the other swellable seal comprising another swellable material, and the swellable materials being different materials. Another swellable packer can include at least one swellable seal, the seal comprising a swellable material, and at least one other swellable seal, the other swellable seal comprising another swellable material, and wherein one swellable seal displaces the other swellable seal into contact with a well surface, in response to contact between the one swellable seal and an activating agent.

10 Claims, 4 Drawing Sheets

SWELLABLE PACKER WITH ENHANCED OPERATING ENVELOPE

CROSS REFERENCE TO RELATED APPLICATIONS

This application is a Continuation of U.S. patent application Ser. No. 14/400,963, filed Nov. 13, 2014, which application is a national stage under 35 USC 371 of International Application No. PCT/US12/43287, filed on 20 Jun. 2012. The entire disclosure of each of which is incorporated herein by this reference.

TECHNICAL FIELD

This disclosure relates generally to equipment utilized and operations performed in conjunction with a subterranean well and, in one example described below, more particularly provides a swellable packer with an enhanced operating envelope.

BACKGROUND

A swellable packer is typically used to seal off an annulus between a tubular string and a casing or formation wall. Unfortunately, swellable materials used to construct swellable packers can be subject to degradation due to, for example, elevated downhole temperatures, well fluids (such as, oil, gas, acid, other chemicals), etc.

Therefore, it will be appreciated that improvements are continually needed in the art of constructing swellable packers.

SUMMARY

In this disclosure, a swellable packer is provided which brings improvements to the art. One example is described below in which a combination of different swellable materials are used to construct the swellable packer. Another example is described below in which one swellable material functions at least partially to prevent extrusion of another swellable material.

A swellable packer is described below. In one example, the swellable packer can include a base pipe, at least one first swellable seal on the base pipe, the first seal comprising a first swellable material, and at least one second swellable seal on the base pipe, the second swellable seal comprising a second swellable material. The first and second swellable materials can be different materials.

Another swellable packer is described below. In an example, the swellable packer can include at least one first swellable seal, the first seal comprising a first swellable material, and at least one second swellable seal, the second swellable seal comprising a second swellable material. The first swellable seal displaces the second swellable seal into contact with a well surface, in response to contact between the first swellable seal and an activating agent.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
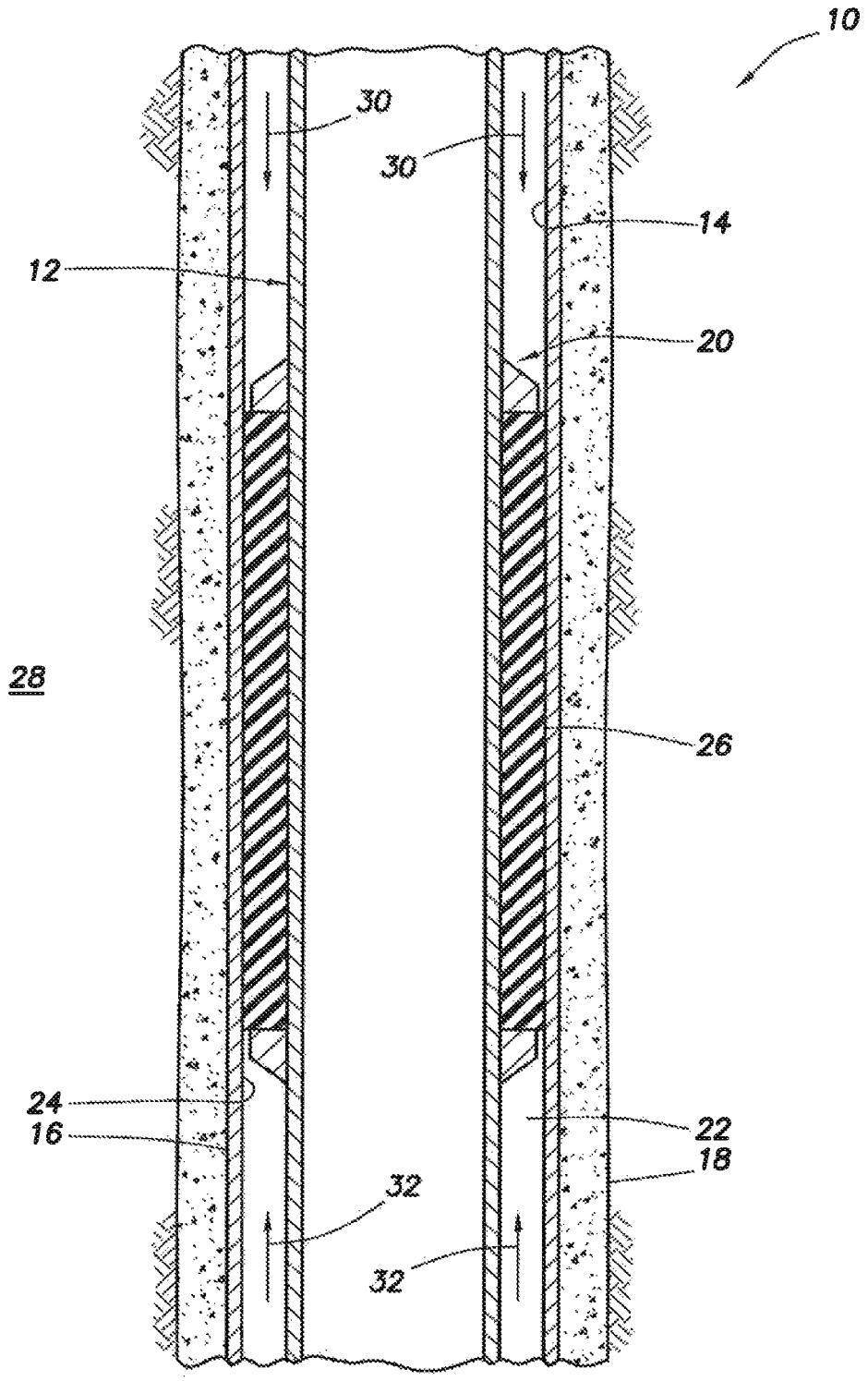
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 has been installed in a wellbore 14 lined with casing 16 and cement 18. A swellable packer 20 interconnected in the tubular string 12 seals off an annulus 22 formed radially between the tubular string and the wellbore 14.

It is not necessary for the wellbore 14 to be lined with casing 16 or cement 18. Instead, the wellbore 14 could be uncased or open hole. In that situation, a well surface 24 against which a swellable seal assembly 26 seals could be a wall of an earth formation 28 penetrated by the wellbore 14.

In examples of the swellable packer 20 described more fully below, the swellable seal assembly 26 includes multiple different swellable materials, with each of the materials contributing to the operating envelope (differential pressure rating, operating temperature range, resistance to certain chemicals, etc.) of the swellable packer. For example, one swellable material could be selected for its capability of swelling relatively quickly in response to contact with an activating agent 30 (e.g., in order to quickly obtain sealing contact with the well surface 24), and another swellable material could be selected for its long term capability to resist extrusion or degradation due to elevated downhole temperatures, or contact with well fluids 32 (such as, oil, gas, water, etc.), acids, other chemicals, etc. Thus, one of the swellable materials provides one capability, and another of the swellable materials provides another capability, thereby expanding the overall operating envelope of the swellable packer 20.

The term "swell" and similar terms (such as "swellable") are used herein to indicate an increase in volume of a swellable material. Typically, this increase in volume is due to incorporation of molecular components of an activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent 30 which causes swelling of the swellable material can be a hydrocarbon fluid (such as oil or gas). In the well system 10, the swellable material may swell when the fluid 32 comprises the activating agent 30 (e.g., when the fluid 32 enters the wellbore 14 from the formation 28), or when the activating agent is circulated to the packer 20, when the activating agent is released from a chamber carried with the packer, etc. In response, the seal assembly 26 seals off the annulus 22 and applies a gripping force to the wellbore 14.

The activating agent 30 which causes swelling of the swellable material could be comprised in any type of fluid. The activating agent 30 could be naturally present in the well, or it could be conveyed with the packer 20, conveyed separately, or flowed into contact with the swellable material in the well when desired. Any manner of contacting the activating agent with the swellable material may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material may have a substantial portion of cavities therein which are compressed or collapsed at the surface condition. Then, after being placed in the well at a higher pressure, the material is expanded by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

The swellable material used in the packer 20 may swell by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material could also swell in response to contact with any of multiple activating agents. For example, the swellable material could swell when contacted by hydrocarbon fluid, or when contacted by water.

Figure 2:
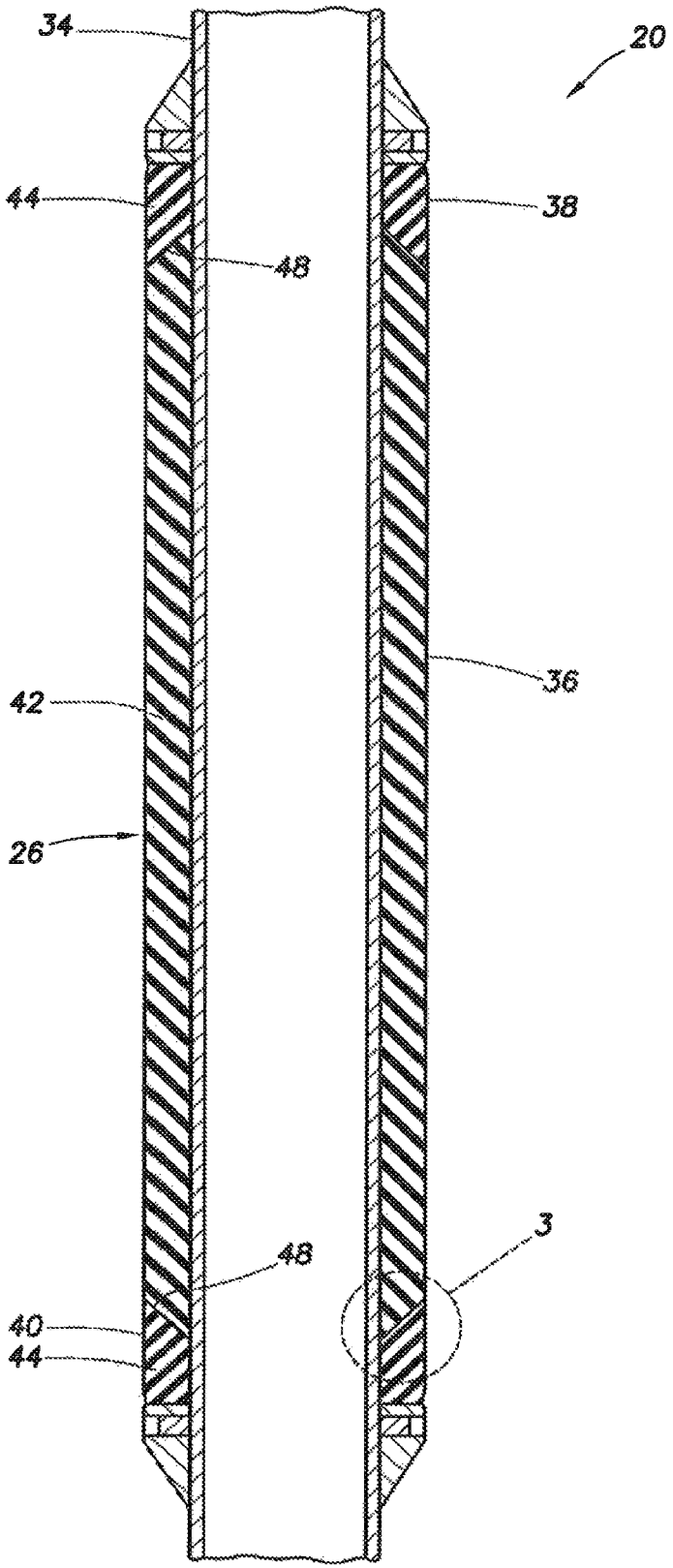
FIG. 2 is a representative enlarged scale cross-sectional view of a swellable packer which can embody principles of this disclosure.

Referring additionally now to FIG. 2, an enlarged scale cross-sectional view of one example of the swellable packer 20 is representatively illustrated. The swellable packer 20 may be used in the system 10 and method of FIG. 1, or it may be used in other systems and methods.

In the FIG. 2 example, the swellable seal assembly 26 is positioned on and surrounding a base pipe 34. The base pipe 34 can be provided with suitable (e.g., threaded) end connections for connecting the packer 20 in the tubular string 12.

The swellable seal assembly 26 includes swellable seals 36, 38, 40. The seals 38, 40 longitudinally straddle the seal 36 on the base pipe 34.

The seal 36 comprises a swellable material 42 which is different from a swellable material 44 of the other seals 38, 40. For example, the swellable material 42 could be one which relatively quickly swells in response to contact with an activating agent. The swellable material 44 could swell at a lesser rate, but could have greater resistance to extrusion or elevated temperatures, or greater resistance to degradation due to contact with acids, certain chemicals, oil, gas, other fluids, etc.

In this manner, the seal 36 can relatively quickly seal against the well surface 24, and the seals 38, 40 can provide long term sealing in the harsh well environment. Note that any number or combination of swellable materials, and any number or combination of swellable seals may be used, in keeping with the scope of this disclosure.

Figure 3:
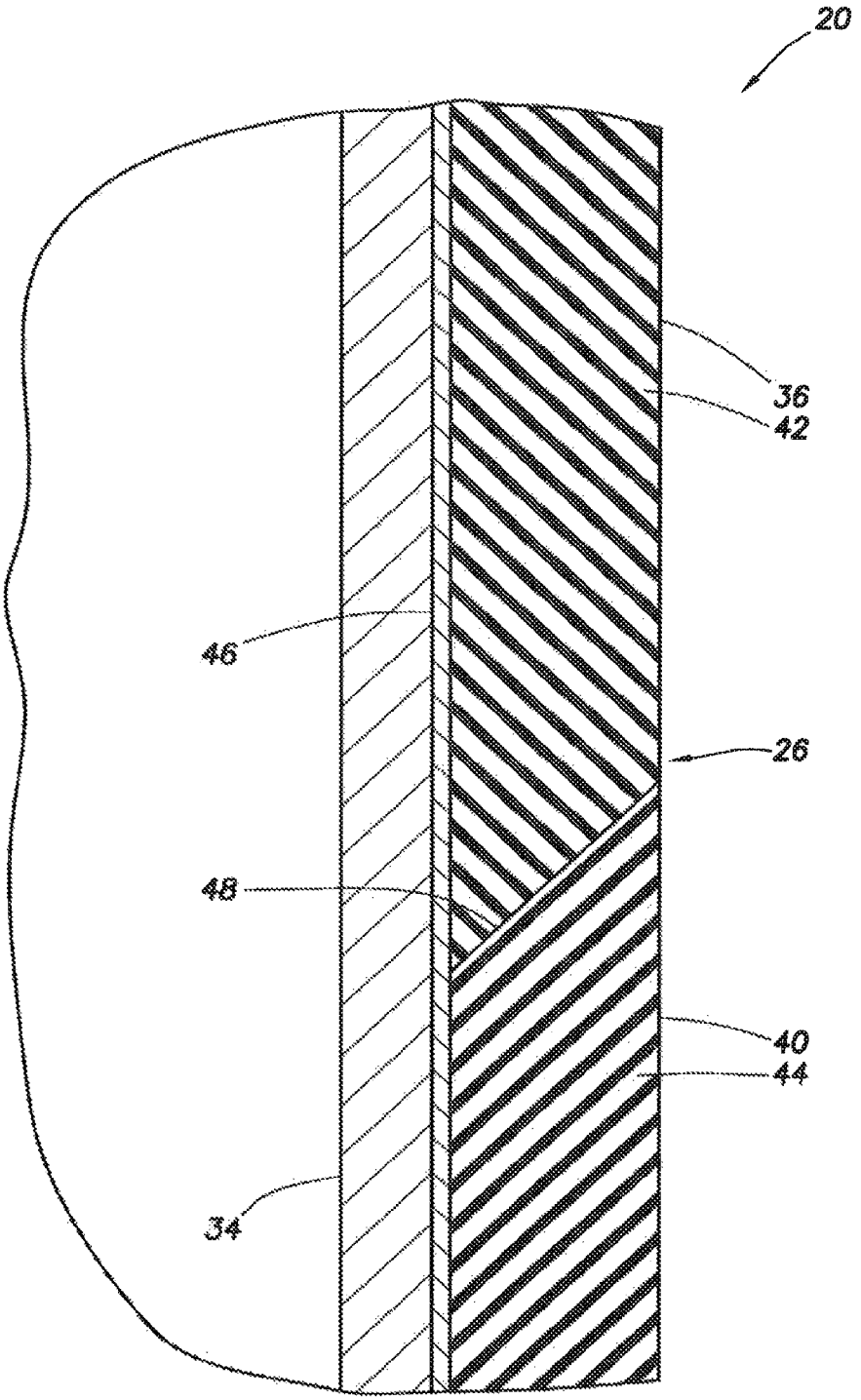
FIG. 3 is a representative further enlarged scale cross-sectional view of a portion of another example of the swellable packer.

Referring additionally now to FIG. 3, an enlarged cross-sectional view of another example of the swellable packer 20 is representatively illustrated. This example differs from the FIG. 2 example at least in that the seal assembly 26 is configured for slipping onto the base pipe 34 as an integral assembly, with the swellable seals 36, 38, 40 being attached to a sleeve 46 prior to being slid onto and secured to the base pipe.

Any manner of attaching the swellable seals 36, 38, 40 to the base pipe 34 may be used in keeping with the principles of this disclosure, whether or not the sleeve 46 is also used. For example, the seals 36, 38, 40, or any of them, could be wrapped about, molded onto, bonded to, or otherwise attached to the base pipe 34.

Furthermore, the seal assembly 26 can include any number, configuration or combination of swellable seals. It is not necessary for particular seals to straddle any other seal or seals. Therefore, it should be clearly understood that the scope of this disclosure is not limited to the seal assembly 26 described herein or depicted in the drawings, or to any particular number, configuration or combination of seals.

In the FIG. 3 example, it can be seen that the seals 36, 40 contact each other along an inclined frusto-conical interface surface 48. This interface surface 48 allows a portion of the seal 36 to be radially beneath a portion of the seal 40.

If, as mentioned above, the swellable material 42 swells more rapidly than the swellable material 44, the portion of the seal 36 beneath the portion of the seal 40 will swell appreciably before the portion of the seal 40 swells. An effect of this will be for the seal 36 to push or otherwise displace the seal 40 radially outward.

A benefit of this configuration can be for the seal 40 to close off an extrusion gap between the packer 20 and the well surface 24. If the swellable material 44 has greater extrusion resistance than the swellable material 42, or greater resistance to degradation in the wellbore 14 environment, this configuration can result in mitigation of extrusion of the seal 36, while preserving the capability to quickly obtain sealing engagement with the well surface 24.

However, it is not necessary for the seal 36 to swell quicker, or to have less resistance to extrusion or degradation in the wellbore 14 environment, as compared to the seal 38 or 40. In other examples, the seals 38, 40 could swell at least as rapidly as the seal 36, or could have the same or less resistance to extrusion or degradation in the wellbore 14 environment.

Figure 4:
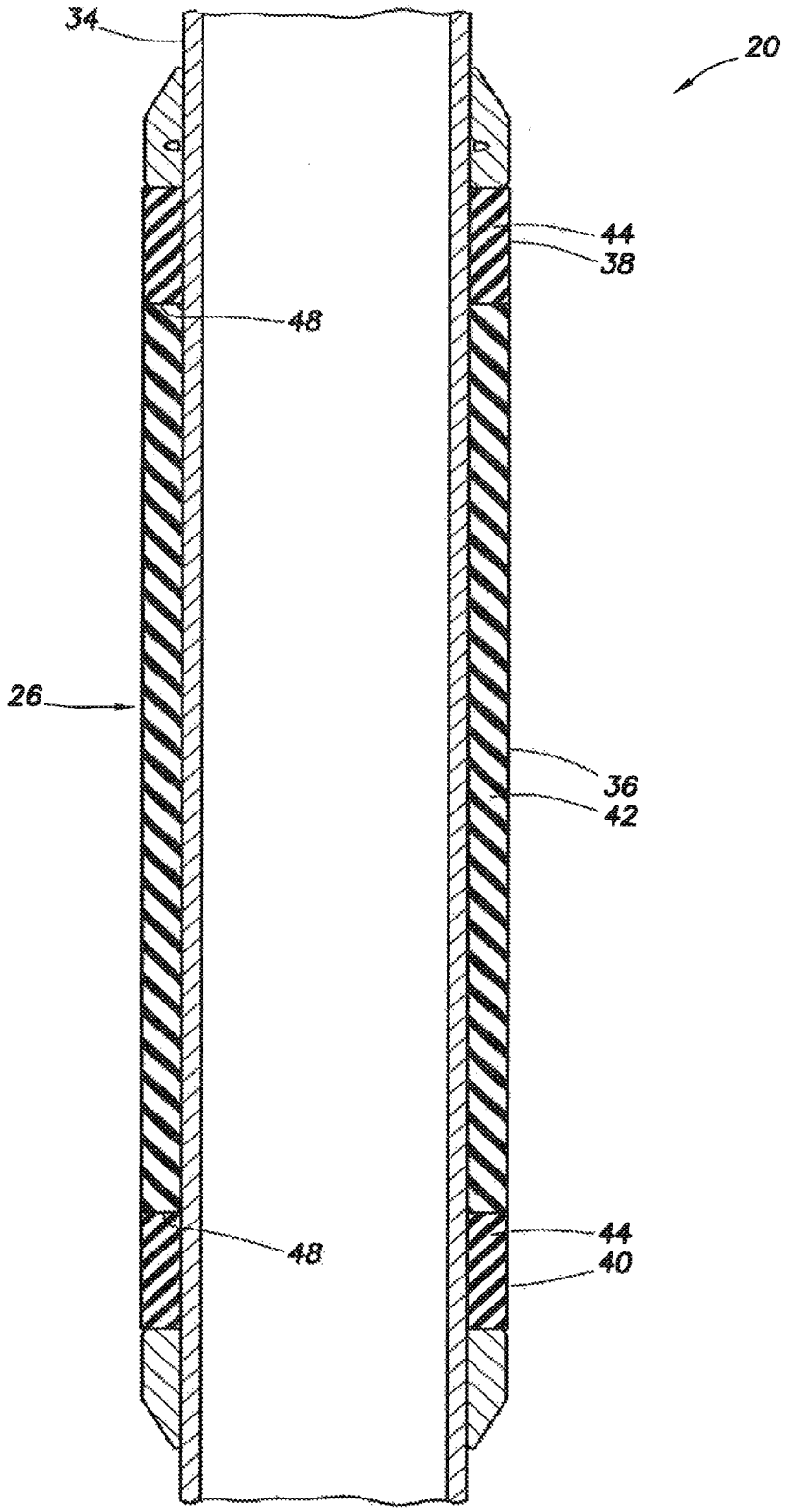
FIG. 4 is a representative cross-sectional view of yet another example of the swellable packer.

Referring additionally now to FIG. 4, another example of the swellable packer 20 is representatively illustrated. In this example, the interface surface 48 between the seal 36 and each of the seals 38, 40 is not frusta-conical in shape, but is instead flat and annular shaped. This demonstrates that a variety of different configurations of the packer 20 are possible, and the scope of this disclosure is not limited at all to the specific examples described above.

Non-limiting examples of suitable materials for use as the swellable materials 42, 44 include oil swelling materials and water swelling materials. Suitable oil swelling materials can include any vulcanized rubber compound based on any rubber polymer, or blend of one or more rubber polymers, which would be given a class rating of A to F in the current edition of American Society for Testing and Materials (ASTM) specification D2000. Preferably, a suitable polymeric or non-metallic oil swelling material material or composition which, when capable of being extended in the range of 30 to 1000%, would exhibit a volume swell of above 60% in IRM 903 test oil. Suitable water swelling materials can include any polymeric or non-metallic material or composition which, when capable of being extended in the range of 30 to 1000%, would exhibit a volume swell of above 60% in potable water at any temperature up to 200 deg. C.

It may now be fully appreciated that this disclosure provides significant advancements to the art of constructing swellable packers. One example is described above in which a combination of different swellable materials 42, 44 are used to construct the swellable packer 20. Another example is described above in which one swellable material 44 functions at least partially to prevent extrusion of another swellable material 42.

A swellable packer 20 is described above. In one example, the swellable packer 20 can comprise a base pipe 34, at least one first swellable seal 36 on the base pipe 34, the first seal 36 comprising a first swellable material 42, and at least one second swellable seal 38, 40 on the base pipe 34, the second swellable seal 38, 40 comprising a second swellable material 44, and the first and second swellable materials 42, 44 being different materials.

The first and second swellable materials 42, 44 may have different resistances to degradation due to elevated temperature. The first and second swellable materials 42, 44 may have different resistances to degradation due to chemical attack, due to contact with acid, due to contact with oil, due to contact with water, due to contact with gas, and/or due to contact with a fluid 32.

The first and second swellable materials 42, 44 may swell at different rates. The first and second swellable materials 42, 44 may have different extrusion resistances.

The first swellable seal 36 may push the second swellable seal 38, 40 outward into contact with a well surface 24 in response to contact between the first swellable seal 36 and an activating agent.

The first and second swellable seals 36, 38, 40 can be positioned longitudinally adjacent each other on the base pipe 34. The first and second swellable seals 36, 38, 40 may contact each other along a frusto-conical interface surface 48.

Two of the second swellable seals 38, 40 may longitudinally straddle the first swellable seal 36, and the first swellable material 42 may swell faster than the second swellable material 44 in response to contact with an activating agent.

Also described above is an example of a swellable packer 20 which comprises at least one first swellable seal 36, the first seal 36 comprising a first swellable material 42, and at least one second swellable seal 38, 40, the second swellable seal 38, 40 comprising a second swellable material 44. The first swellable seal 36 displaces the second swellable seal 38, 40 into contact with a well surface 24, in response to contact between the first swellable seal 36 and an activating agent.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A swellable packer, comprising:

a base pipe;

at least one first swellable seal on the base pipe, the first seal comprising a first swellable material; and at least two second swellable seals on the base pipe, the second swellable seals comprising a second swellable material, and the first and second swellable materials being different materials, wherein two of the second swellable seals longitudinally straddle the first swellable seal, and wherein the first swellable material swells faster than the second swellable material in response to contact with an activating agent, wherein the second swellable seals hold back ends of the first swellable seal from swelling while the first swellable seal pushes the second swellable seals outward into contact with a well surface in response to contact between the first swellable seal and an activating agent.

2. The packer of claim 1, wherein the first and second swellable materials have different resistances to degradation due to elevated temperature.

3. The packer of claim 1, wherein the first and second swellable materials have different resistances to degradation due to chemical attack.

4. The packer of claim 1, wherein the first and second swellable materials have different resistances to degradation due to contact with acid.

5. The packer of claim 1, wherein the first and second swellable materials have different resistances to degradation due to contact with oil.

6. The packer of claim 1, wherein the first and second swellable materials have different resistances to degradation due to contact with water.

7. The packer of claim 1, wherein the first and second swellable materials have different resistances to degradation due to contact with gas.

8. The packer of claim 1, wherein the first and second swellable materials have different resistances to degradation due to contact with a well fluid.

9. The packer of claim 1, wherein the first and second swellable materials swell at different rates.

10. The packer of claim 1, wherein the first and second swellable materials have different extrusion resistances.

* * * * *